US009822984B2

(12) United States Patent
Brunner et al.

(10) Patent No.: US 9,822,984 B2
(45) Date of Patent: Nov. 21, 2017

(54) TELESCOPING PULL-OUT DEVICE

(75) Inventors: Martin Brunner, Pforzheim (DE); Manfred Hintermayer, Karlsruhe (DE)

(73) Assignee: BSH Hausgeräte GmbH, Munich (DE)

( * ) Notice: Subject to any disclaimer, the term of this patent is extended or adjusted under 35 U.S.C. 154(b) by 1074 days.

(21) Appl. No.: 11/922,583

(22) PCT Filed: Jun. 13, 2006

(86) PCT No.: PCT/EP2006/063117
§ 371 (c)(1),
(2), (4) Date: Dec. 18, 2007

(87) PCT Pub. No.: WO2006/136508
PCT Pub. Date: Dec. 28, 2006

(65) Prior Publication Data

US 2009/0079313 A1 Mar. 26, 2009

(30) Foreign Application Priority Data

Jun. 21, 2005 (DE) ..... 10 2005 028 674

(51) Int. Cl.

| | |
|---|---|
| ***F24C 15/16*** | (2006.01) |
| ***A47B 95/00*** | (2006.01) |
| ***A47B 88/49*** | (2017.01) |
| *A47B 81/00* | (2006.01) |

(52) U.S. Cl.
CPC ..... *F24C 15/168* (2013.01); *A47B 88/49* (2017.01); *A47B 2210/0081* (2013.01)

(58) Field of Classification Search
USPC ..... 126/332, 337 R, 339; 312/334.44, 312/334.46, 410, 334.7, 334.8, 333, 312/334.27, 334.29–334.32; 211/172
See application file for complete search history.

(56) References Cited

U.S. PATENT DOCUMENTS

| | | | | |
|---|---|---|---|---|
| 2,033,860 | A | | 3/1936 | Otte |
| 2,732,240 | A | * | 1/1956 | Hutzelman ..... 292/175 |
| 3,397,001 | A | * | 8/1968 | Friedman ..... 292/87 |
| 5,417,489 | A | * | 5/1995 | Compagnucci ..... 312/334.11 |

(Continued)

FOREIGN PATENT DOCUMENTS

| | | |
|---|---|---|
| DE | 35 05 542 | 9/1986 |
| DE | 38 15 440 | 11/1989 |

(Continued)

OTHER PUBLICATIONS

International Search Report PCT/EP2006/063117.

*Primary Examiner* — Steven B McAllister
*Assistant Examiner* — Desmond C Peyton
(74) *Attorney, Agent, or Firm* — Michael E. Tschupp; Andre Pallapies; Brandon G. Braun

(57) ABSTRACT

The invention relates to a telescoping pull-out device for household appliances and furniture, especially a pull-out system for an oven. The telescoping pull-out device includes a first telescoping rail mounted in such a way that it can be displaced between a retracted position and an extended position. The telescoping pull-out device operates in a manner which prevents an uncontrolled and/or undesired automatic extension of the telescoping rail. The telescoping pull-out device includes a catch element for catching the first telescoping rail in the retracted position.

23 Claims, 3 Drawing Sheets

(56) References Cited

U.S. PATENT DOCUMENTS

Figure 1:
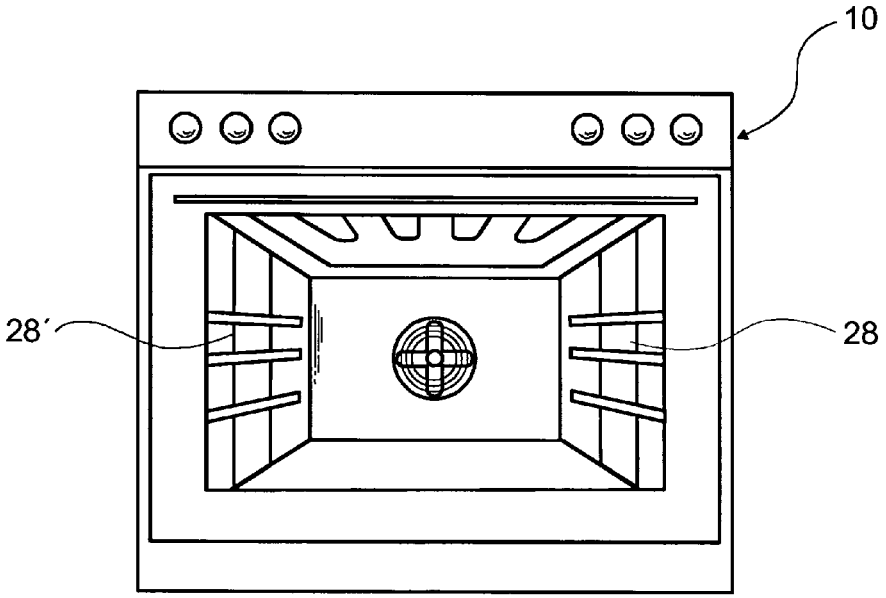

| | | | | |
|---|---|---|---|---|
| 5,417,490 | A * | 5/1995 | Hobbs et al. | 312/334.47 |
| 5,671,988 | A | 9/1997 | O'Neill | |
| 5,795,044 | A * | 8/1998 | Trewhella et al. | 312/333 |
| D426,749 | S * | 6/2000 | Barnes et al. | D7/409 |
| 6,112,916 | A * | 9/2000 | Barnes et al. | 211/153 |
| 6,113,204 | A * | 9/2000 | Jahrling et al. | 312/334.31 |
| 6,155,661 | A * | 12/2000 | O'Neil et al. | 312/334.44 |
| 6,244,678 | B1 | 6/2001 | Dopp et al. | |
| 6,416,143 | B1 * | 7/2002 | Janson | 312/201 |
| 6,435,636 | B1 * | 8/2002 | MacMillan | 312/334.46 |
| 6,643,900 | B2 * | 11/2003 | Jahrling | 24/563 |
| 6,789,861 | B1 | 9/2004 | Dobberstein | |
| 6,834,923 | B2 * | 12/2004 | Young et al. | 312/334.8 |
| 6,854,816 | B2 * | 2/2005 | Milligan | 312/334.11 |
| 6,926,001 | B2 * | 8/2005 | Bartley | 126/337 R |
| 6,938,617 | B2 * | 9/2005 | Le et al. | 126/339 |
| 6,976,597 | B2 * | 12/2005 | Jahrling et al. | 211/175 |
| 7,216,646 | B2 * | 5/2007 | Le et al. | 126/339 |
| 7,441,951 | B2 * | 10/2008 | Rauh | 378/167 |
| 7,448,508 | B2 * | 11/2008 | Babucke et al. | 211/126.9 |
| 7,458,651 | B1 * | 12/2008 | Radke et al. | 312/333 |
| 7,552,982 | B2 * | 6/2009 | Beaudoin | 312/334.47 |
| 7,604,307 | B2 * | 10/2009 | Greenwald et al. | 312/333 |
| 7,654,625 | B2 | 2/2010 | Amann et al. | |
| 7,909,420 | B2 * | 3/2011 | Jahrling | 312/228.1 |
| 2002/0057042 | A1 * | 5/2002 | Milligan | 312/334.46 |
| 2003/0079615 | A1 * | 5/2003 | Pattle et al. | 99/448 |
| 2003/0192847 | A1 * | 10/2003 | Jahrling et al. | 211/175 |
| 2004/0000851 | A1 * | 1/2004 | Lam Harn | A47B 88/493 312/334.7 |
| 2004/0012313 | A1 * | 1/2004 | MacMillan | A47B 88/493 312/334.44 |
| 2004/0056572 | A1 * | 3/2004 | Chen et al. | 312/333 |
| 2004/0112371 | A1 * | 6/2004 | Le et al. | 126/334 |
| 2004/0130248 | A1 * | 7/2004 | Chi | 312/334.8 |
| 2004/0174101 | A1 * | 9/2004 | Lin | 312/333 |
| 2004/0261785 | A1 * | 12/2004 | Wiedenmann et al. | 126/339 |
| 2005/0116595 | A1 * | 6/2005 | Milligan | 312/334.46 |
| 2005/0217501 | A1 * | 10/2005 | Babucke et al. | 99/450 |
| 2006/0065265 | A1 * | 3/2006 | Erdmann et al. | 126/339 |
| 2006/0091771 | A1 * | 5/2006 | Teskey | 312/334.44 |
| 2006/0152115 | A1 * | 7/2006 | Dubon et al. | 312/334.8 |
| 2007/0057609 | A1 * | 3/2007 | Lam et al. | 312/334.31 |
| 2007/0261694 | A1 * | 11/2007 | Le et al. | 126/339 |

FOREIGN PATENT DOCUMENTS

| | | | | |
|---|---|---|---|---|
| DE | 3818225 | A1 | 12/1989 | |
| DE | 41 42 346 | | 6/1993 | |
| DE | 43 07 911 | | 9/1994 | |
| DE | 43 07 911 | A1 * | 9/1994 | A47B 88/04 |
| DE | 4307911 | A1 * | 9/1994 | A47B 88/04 |
| DE | 19908843 | A1 | 9/2000 | |
| DE | 100 51 153 | | 4/2002 | |
| EP | 1 014 004 | B1 | 6/2000 | |
| JP | 2001190347 | A | 7/2001 | |
| WO | WO 2004/005820 | | 1/2004 | |
| WO | WO 2004005820 | A2 * | 1/2004 | |

* cited by examiner

TELESCOPING PULL-OUT DEVICE

The invention proceeds from a household appliance as claimed in the preamble of claim 1.

A telescoping pull-out device of a pull-out system for an oven with a first telescoping rail supported to allow it to move between a retracted and an extended position is known from EP 1 014 004 B1.

The underlying object of the invention is especially to provide a generic telescoping pull-out device in which an uncontrolled and/or undesired automatic extension of the first telescoping rail can be avoided.

The object is achieved in accordance with the invention by the features of claim 1, while advantageous embodiments and developments of the invention can be taken from the subclaims.

The basis for the invention is a telescoping pull-out device for household appliances and furniture, especially a pull-out system for an oven, with at least one telescoping rail supported to allow it to move between a retracted and an extended position.

It is proposed that the telescoping pull-out device includes at least one catch element for latching the first telescoping rail in the retracted position. This enables the undesirable situation to be avoided in which the first telescoping rail moves out of its retracted position and causes an obstruction. This makes for added convenience, especially with telescoping pull-out devices which are not installed precisely horizontally and during cleaning of the telescoping pull-out devices. Damage to the projecting first telescoping rail can also be avoided.

In a development of the invention it is proposed that the first telescoping rail be provided to allow it to be released from a household appliance. The advantages able to be obtained by avoiding unintentional automatic extension are particularly apparent in this case. A controllable behavior of the telescoping pull-out device or of the system can be achieved especially in a releasable system with a plurality of telescoping devices and in telescoping devices with a plurality of movable first telescoping rails.

An advantageous functional integration at maximum extension length is able to be achieved if the catch element is formed on a closure part of the first telescoping rail.

Savings in components can be achieved if a further catch element corresponding to the catch element is formed onto a carrier element.

If the catch element is provided to stabilize the first telescoping rail in the retracted position in a direction running perpendicular to a longitudinal direction of the first telescoping rail, rattling during transport and an unsightly tilting of the first telescoping rail in a non-loaded state can be avoided. In an especially simple construction the catch element can be embodied as a latching lug.

A stable latching with little force applied to establish the latching connection is achievable if the telescoping pull-out device comprises at least one catch element with an inclined surface. The inclined surface can be joined to both the first, movable telescoping rail and also to the second telescoping rail or can be formed onto the telescoping rail.

A homogeneous visual impression and a low susceptibility to contamination can be achieved if the catch element is covered at least in the retracted position of the first telescoping rail.

A telescoping pull-out device able to be pulled out beyond the length of the first telescoping rail can be achieved if the telescoping pull-out device features at least one second telescoping rail movable in relation to a carrier element, which is arranged between the carrier element and the first telescoping rail.

The result able to be achieved in this way is that the second telescoping rail in the retracted position is securely fixed between the first telescoping rail and the carrier element, if the catch element makes a direct latching connection between the first telescoping rail and the carrier element.

Furthermore the invention relates to a cooking appliance with at least one inventive telescoping device. Since there are often a plurality of non-loaded telescoping devices with pull-out telescoping mechanisms in cooking appliances with telescoping devices, an especially marked improvement in convenience can be achieved here. Furthermore the benefits with regard to the cleaning characteristics are especially significant in cooking appliances. The term cooking appliances in this context covers ovens, grills, microwave ovens, steamers and cooking appliances with combined and/or further functions.

Further advantages emerge from the description of the drawing given below. The drawing shows an exemplary embodiment of the invention. The drawing, the description and the claims contain numerous features in combination. The person skilled in the art would expediently also consider the features individually and combine them into further sensible combinations.

Figure 2:
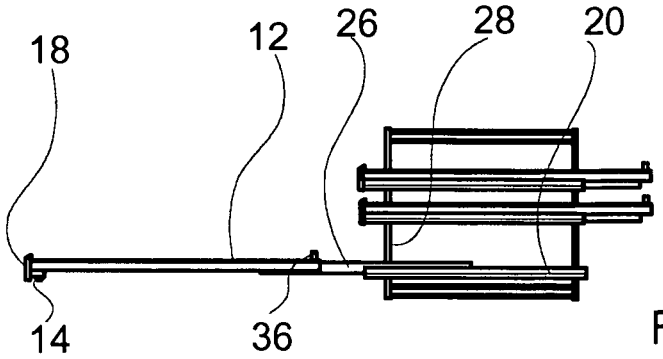
Figure 3:
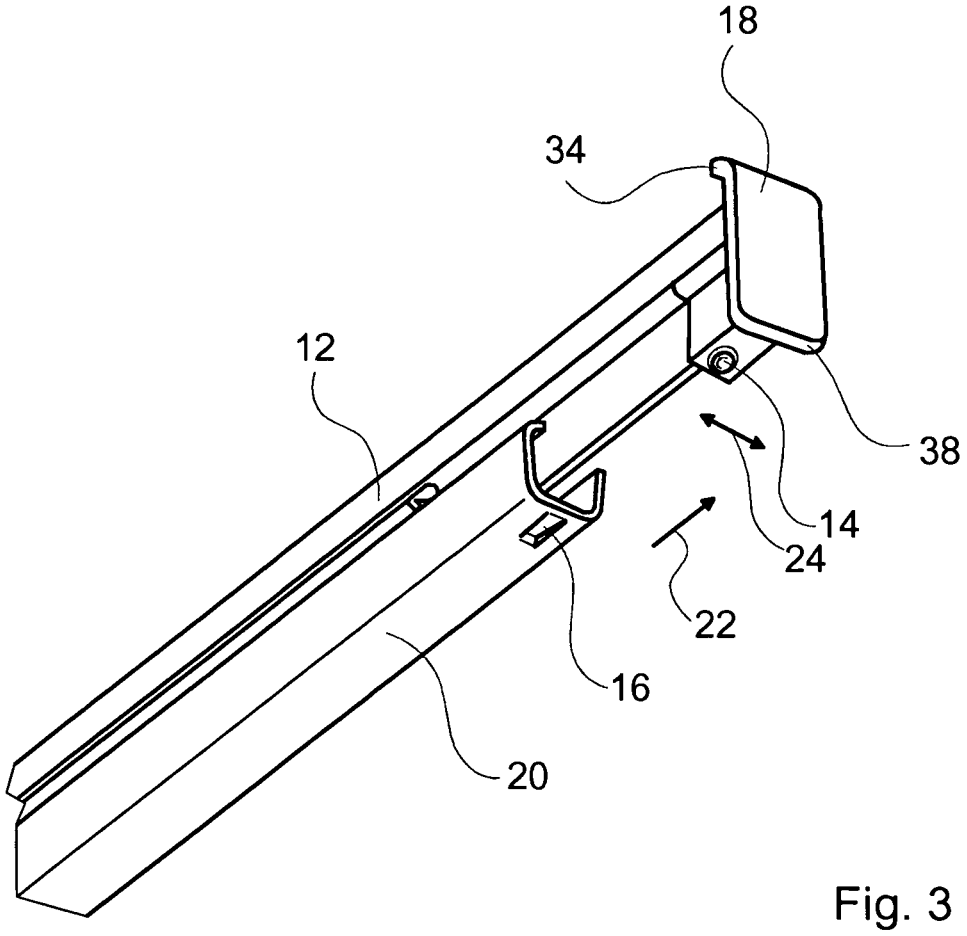
Figure 4:
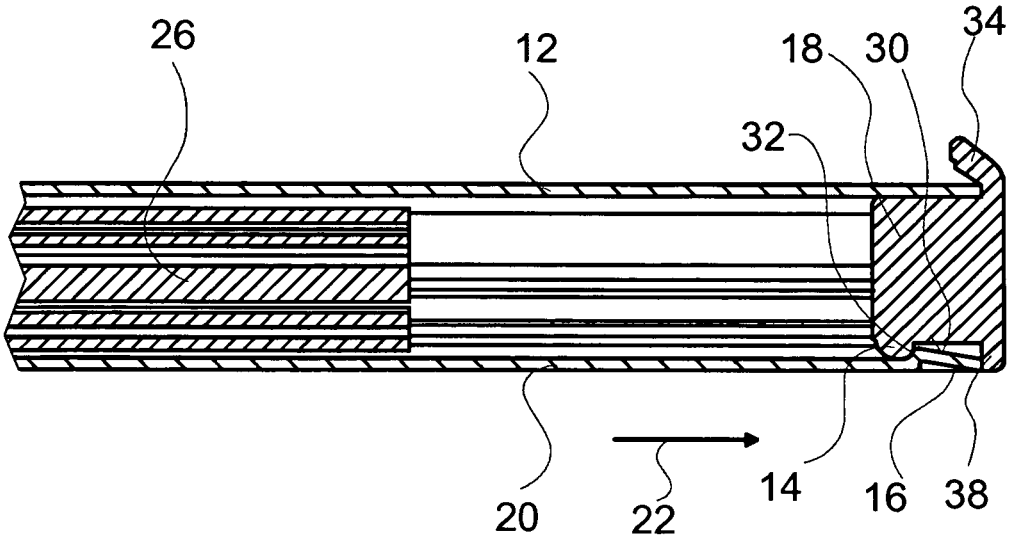
Figure 5:
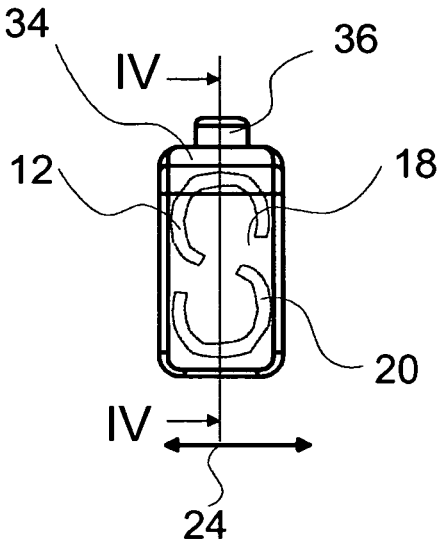

The figures show:

FIG. 1 a cooking appliance with a number of telescoping pull-out devices,

FIG. 2 a system of telescoping pull-out devices of the cooking appliance from FIG. 1, FIG. 3 the telescoping pull-out device from FIGS. 1 and 2 viewed at an angle from below, FIG. 4 the telescoping pull-out device from FIGS. 1-3 in a retracted position in a cross-sectional view and FIG. 5 the telescoping pull-out device from FIGS. 1-4 in a front view.

FIG. 1 shows a household appliance 10 embodied as a domestic oven or cooker with a total of six telescoping pull-out devices arranged on the sidewalls of a cooking compartment of the household appliance 10 which are attached to two side mesh-type and removable carriers 28, 28'. The telescoping pull-out devices each consist of a rail-type carrier element 20, which is connected to the carriers 28, 28', and of two telescopic rails 12, 26 held to allow movement relative to the carrier element 20 and relative to each other in a longitudinal direction 22. The second telescoping rail 26 is supported between the carrier element 20 and the first telescoping rail 12 via a ball race not shown explicitly here in each case.

Attached to each of the carriers 28, 28' are three parallel telescoping pull-out devices, with two forming a pair in each case on different carriers 28, 28' and being arranged at the same height. The carriers 28, 28' can be attached via keyhole openings in the cooking compartment of the household appliance 10 or released from this to enable the system consisting of the respective carrier 28' and the telescoping pull-out devices connected to it (FIG. 2) to be removed and cleaned. The system can be put into a dishwasher for cleaning.

The carrier element 20 and the first telescoping rail 12 each have an essentially U-shaped profile. The two profiles are open in relation to each other and join together to form a rectangular overall profile of the telescoping pull-out device (FIG. 3). The second telescoping rail 26 is arranged inside the overall profile. Pressed onto an end of the first telescoping rail 12 pointing in the installed state in a direction of the opening of the household appliance 10 is a closure part 18 made of diecast aluminum with added chrome and nickel, which in a retracted position, in which the first telescoping rail 12 and the carrier element 20 are arranged above one another, closes off the rectangular overall profile of the telescoping pull-out device in the longitudinal direction 22. In this case the closure part 18 engages in a front end area in the carrier element 20 and lies above a contact flange 38 at a front edge of the carrier element 20.

Punched or formed into the front end area of the carrier element 20 is a catch element 16 embodied as a latching lug which engages with a knob-shaped catch element 14 which is formed on the closure part 18. The catch element 16 has an inclined or a sawtooth shape and features an inclined surface 30 sloping towards the end of the carrier element 20. When the first telescoping rail 12 is pushed in the catch element 14 comes into contact with the inclined surface 30 of the catch element 16 and slides over this to the end of the ramp surface 30. When it reaches the retracted position the catch element 14 latches over an end edge 32 of the inclined surface 30 of the catch element 16, so that the first telescoping rail 12 is latched via the catch elements 14, 16 in the retracted position. The catch elements 14, 16 establish a direct latching connection between the first telescoping rail 12 and the carrier element 20 (FIG. 5). As the assembly is pushed in, the first telescoping rail 12 is displaced horizontally upwards by the pressure exerted via the inclined surface 30 on the catch element 14 by utilizing installation play and elasticity of the telescoping pull-out device and drops back when latched. The end edge 32 of the inclined surface 30 is embodied in the shape of a swan neck and thereby holds the catch element 14 in a horizontal direction 24 running perpendicular to the longitudinal direction 22 (FIG. 5), so that the telescoping rail 12 is stabilized by the latching elements 14, 16 in the retracted position in the direction 24 and in an inactive state cannot tilt in the retracted position. The arrangement of the catch elements 14, 16 on the telescoping rails can also be inverted in a further embodiment of the invention.

The surface of the telescoping pull-out device is formed in the retracted position completely by the outer sides of the telescoping rail 12, of the carrier element 20 and of the closure part 18, so that the catch elements 14, 16 are covered in the retracted configuration by the first telescoping rail 12 and are protected from contamination.

Formed on an upper surface of the closure part 18 is a projection 34 protruding against the longitudinal direction 22 transverse onto a cooking area of the household appliance. In the area of a rear end of the telescoping rail 12 this features a pin 36. A cooking item carrier can be inserted between the projection 34 and the pin 36 which is connected by the pin 36 and the projection 34 in the longitudinal direction 22 with the first telescoping rail 12, so that the first telescoping rail 12 moves when the cooking item carrier is pulled out and/or pushed in together with the first telescoping rail 12.

REFERENCE SYMBOLS

10 Household appliance
12 Telescoping rail
14 Catch element
16 Catch element
18 Closure part
20 Carrier element
22 Longitudinal direction
24 Direction
26 Telescoping rail
28 Carrier
30 Inclined surface
32 End edge
34 Projection
36 Pin
38 Contact flange

The invention claimed is:

1. A telescoping pull-out device for household appliances and furniture, the telescoping pull-out device comprising:

a first carrier element;

an inclined carrier catch element formed in the first carrier element;

a first telescoping rail movably supported on the first carrier element, the first telescoping rail being movable between an extended position in which the first telescoping rail is extended outwardly relative to the first carrier element and a retracted position in which the first telescoping rail is retracted relative to the first carrier element;

a substantially rigid closure component that is part of the first telescoping rail; the closure component having a projection projecting upwardly at an upper portion of the closure component; and a closure component catch element formed onto the closure component, the closure component catch element engaging the carrier catch element when the first telescoping rail in its retracted position, wherein the first telescoping rail moves between its extended position and its retracted position along a rail movement axis, the first telescoping rail includes a distal end that is the end of the first telescoping rail that is furthest away from the carrier element when the first telescoping rail is in its extended position, and the closure component is formed at the distal end of the first telescoping rail, wherein the closure component catch element is arranged on an underside of the first telescoping rail, and wherein the projection projects upwardly above an uppermost surface of the first telescoping rail for holding an item carrier in position on the first telescoping rail.

2. The telescoping pull-out device as claimed in claim 1, wherein the first telescoping rail is configured for removable attachment to a respective one of a household appliance and a furniture item.

3. The telescoping pull-out device as claimed in claim 1, wherein the closure component is configured as a stop that prevents further retraction movement of the first telescoping rail and the closure component catch element is arranged in the area of the stop.

4. The telescoping pull-out device as claimed in claim 1, wherein an entire structure of the carrier catch element is fixed relative to the first carrier element.

5. The telescoping pull-out device as claimed in claim 4, wherein the closure component catch element and the carrier catch element cooperate with one another to stabilize the first telescoping rail in the retracted position in that movement of the first telescoping rail in a direction perpendicular to the movement of the first telescoping rail along the rail movement axis is resisted.

6. The telescoping pull-out device as claimed in claim 4, wherein a selected one of the closure component catch element and the carrier catch element has a surface inclined parallel to the direction of the movement of the first telescoping rail along the rail movement axis.

7. The telescoping pull-out device as claimed in claim 4, wherein a selected one of the closure component catch element and the carrier catch element is covered at least in the retracted position of the first telescoping rail.

8. The telescoping pull-out device as claimed in claim 1 and further comprising a second telescoping rail arranged between the first carrier element and the first telescoping rail and movable relative thereto.

9. The telescoping pull-out device as claimed in claim 8, wherein the closure component catch element is formed on the first telescoping rail and the carrier catch element is formed on the first carrier element and the closure component catch element and the carrier catch element are provided for establishing a direct latching connection between the first telescoping rail and the first carrier element.

10. The telescoping pull-out device as claimed in claim 1, wherein the closure component completely covers the distal end of the first telescoping rail and completely covers an end of the first carrier element.

11. The telescoping pull-out device as claimed in claim 1, further comprising an upwardly projecting member that projects upwardly above the uppermost surface of the first telescoping rail and is located at an end of the first telescoping rail opposite the distal end of the first telescoping rail, wherein the projection and the upwardly projecting member are adapted to hold the item carrier in position between the projection and the upwardly projecting member such that the item carrier moves along the rail movement axis with the first telescoping rail.

12. A cooking appliance comprising:

a body for receiving an item to be cooked; and a telescoping pull-out device mounted to the body, the telescoping pull-out device including:

a first carrier element;

an inclined carrier catch element formed in the first carrier element;

a first telescoping rail movably supported on the first carrier element, the first telescoping rail being movable between an extended position in which the first telescoping rail is extended outwardly relative to the first carrier element and a retracted position in which the first telescoping rail is retracted relative to the first carrier element;

a substantially rigid closure component that is part of the first telescoping rail; the closure component having a projection projecting upwardly at an upper portion of the closure component; and a closure component catch element formed onto the closure component, the closure component catch element engaging the carrier catch element when the first telescoping rail in its retracted position, wherein the first telescoping rail moves between its extended position and its retracted position along a rail movement axis, the first telescoping rail includes a distal end that is the end of the first telescoping rail that is furthest away from the carrier element when the first telescoping rail is in its extended position, and the closure component is formed at the distal end of the first telescoping rail, wherein the closure component catch element is arranged on an underside of the first telescoping rail, and wherein the projection projects upwardly above an uppermost surface of the first telescoping rail for holding an item carrier in position on the first telescoping rail.

13. The cooking appliance as claimed in claim 12, wherein the first telescoping rail is configured for removable attachment to a respective one of a household appliance and a furniture item.

14. The cooking appliance as claimed in claim 12, wherein the closure component is configured as a stop that prevents further retraction movement of the first telescoping rail and the closure component catch element is arranged in the area of the stop.

15. The cooking appliance as claimed in claim 12, wherein an entire structure of the carrier catch element is fixed relative to the first carrier element.

16. The cooking appliance as claimed in claim 15, wherein the closure component catch element and the carrier catch element cooperate with one another to stabilize the first telescoping rail in the retracted position in that movement of the first telescoping rail in a direction perpendicular to the movement of the first telescoping rail along the rail movement axis is resisted.

17. The cooking appliance as claimed in claim 15, wherein a selected one of the closure component catch element and the carrier catch element has a surface inclined parallel to the direction of the movement of the first telescoping rail along the rail movement axis.

18. The cooking appliance as claimed in claim 15, wherein a selected one of the closure component catch element and the carrier catch element is covered at least in the retracted position of the first telescoping rail.

19. The cooking appliance as claimed in claim 12 and further comprising a second telescoping rail arranged between the first carrier element and the first telescoping rail and movable relative thereto.

20. The cooking appliance as claimed in claim 19, wherein the closure component catch element is formed on the first telescoping rail and the carrier catch element is formed on the first carrier element and the closure component catch element and the carrier catch element are provided for establishing a direct latching connection between the first telescoping rail and the first carrier element.

21. The cooking appliance as claimed in claim 12, wherein the closure component completely covers the distal end of the first telescoping rail and completely covers an end of the first carrier element.

22. The cooking appliance as claimed in claim 12, further comprising an upwardly projecting member that projects upwardly above the uppermost surface of the first telescoping rail and is located at an end of the first telescoping rail opposite the distal end of the first telescoping rail, wherein the projection and the upwardly projecting member are adapted to hold the item carrier in position between the projection and the upwardly projecting member such that the item carrier moves along the rail movement axis with the first telescoping rail.

23. The cooking appliance as claimed in claim 22, further comprising the item carrier, wherein the projection and the upwardly projecting member hold the item carrier in position between the projection and the upwardly projecting member such that the item carrier moves along the rail movement axis with the first telescoping rail.

* * * * *